United States Patent [19]

Surko, Jr. et al.

[11] 4,236,396

[45] Dec. 2, 1980

[54] RETROFIT LOCK

[75] Inventors: Walter E. Surko, Jr., Southington; LeRoy Hart, Farmington, both of Conn.

[73] Assignee: Emhart Industries, Inc., Farmington, Conn.

[21] Appl. No.: 950,319

[22] Filed: Oct. 16, 1978

[51] Int. Cl.[2] ..... E05B 3/00; E05B 9/00; E05B 59/00; E05C 1/16

[52] U.S. Cl. ..... 70/107; 70/451; 70/452; 292/37; 292/336.3; 292/336.5; 292/356; 292/357

[58] Field of Search ..... 70/107, 224, 451, 449, 70/448, 452, 370, 381, 380, 129, 120, DIG. 63; 292/33, 37, 337, 336.3, 357, 356, 336.5

[56] References Cited

U.S. PATENT DOCUMENTS

| | | | |
|---|---|---|---|
| 173,853 | 2/1876 | Gardiner | 70/107 |
| 315,205 | 4/1885 | Young | 70/370 |
| 907,234 | 12/1908 | Herr | 70/120 |
| 929,638 | 7/1909 | Voight | 70/107 |
| 1,107,297 | 8/1914 | Grossman | 70/107 |
| 1,229,332 | 6/1917 | Shaw | 70/224 |
| 1,245,049 | 10/1917 | Silverstein . | |
| 1,596,992 | 8/1926 | Ognowicz | 292/37 UX |
| 2,010,461 | 8/1935 | Milligan . | |
| 2,225,545 | 12/1940 | Brantingson | 292/337 X |
| 3,009,347 | 11/1961 | George | 70/448 X |
| 3,099,472 | 7/1963 | Kelsen | 70/451 X |
| 3,101,604 | 8/1963 | North et al. | 70/107 |
| 3,159,993 | 12/1964 | Crepinsek | 70/107 |
| 3,512,381 | 5/1970 | Matsunaga | 70/448 X |
| 3,593,548 | 7/1971 | Kendrick | 292/336.3 X |
| 3,789,633 | 2/1974 | Crepinsek | 292/34 X |
| 3,859,827 | 1/1975 | Garcia | 70/451 X |
| 4,012,929 | 3/1977 | Solovieff | 70/381 X |
| 4,061,383 | 12/1977 | Waldo | 70/107 UX |
| 4,067,212 | 1/1978 | Vorob | 292/37 X |

*Primary Examiner*—Roy D. Frazier
*Assistant Examiner*—Carl F. Pietruszka
*Attorney, Agent, or Firm*—McCormick, Paulding & Huber

[57] ABSTRACT

A lockset having a rim mounted latch bolt and a dead bolt arranged in side-by-side relation on a door for engagement within side-by-side openings in a common strike. The dead bolt projects from an edge of the door and is operated from the inside by a turnpiece assembly and from the outside by a key operated lock cylinder mounted in fixed position relative to the door. Inside and outside lever handles journalled for limited angular movement on the turnpiece assembly and on the lock cylinder, respectively, operate the latch bolt from the inner and outer side of the door. The turnpiece assembly is connected to the lock cylinder and the inside lever handle is connected to the outside lever handle through a single transverse bore formed in the door. The present lockset may be installed on a door to replace a cylindrical lockset of key-in-knob type having a single latch bolt without boring an additional hole in the door.

18 Claims, 12 Drawing Figures

RETROFIT LOCK

BACKGROUND OF THE INVENTION

This invention relates in general to locks and deals more particularly with an improved lockset which includes a dead bolt and a latch bolt and which is particularly adapted to replace a cylindrical lockset of key-in-knob type. Cylindrical locksets of the aforedescribed type, commonly used in residential installations, afford only limited security. Such key-in-knob locksets usually have a single latch bolt, but may include an auxiliary latch which deadlocks the latch bolt to prevent latch bolt manipulation when the door is closed. The outside knob is usually arranged so that it may be locked in non-rotatable position to prevent latch bolt retraction. Since the throw of the latch bolt usually does not exceed ½ inch, such a lockset may often be defeated by prying the door jamb away from the door. The locked outside knob which carries the lock mechanism is also quite vulnerable to attack. If a greater degree of security is desired an auxiliary bolt is often installed, usually above the lockset, to provide desired dead bolting function. However, installation of such an auxiliary bolt usually requires that one or more additional holes be bored in the door to receive the auxiliary bolt and that an additional recess be formed in the door jamb to accommodate an additional strike. The average home owner does not usually have the special tools or skill required to make a proper auxiliary bolt installation.

The general aim of the present invention is to provide an improved retrofit lockset, that is a lockset which may be readily substituted for an existing one, but which includes important features not found in the lockset which it replaces. More specifically, it is the aim of the present invention to provide an improved lockset which may be substituted for an existing one to provide both latching and dead bolting functions and which may be installed without special tools by a person of ordinary mechanical skill. A further aim of the invention is to provide an improved compact lockset which has both latching and dead bolting functions and which may be installed as original equipment on a door prepared with a single transverse bore and another bore in its edge which opens into the transverse bore.

SUMMARY OF THE INVENTION

In accordance with the present invention a lockset is provided for a door which has a transverse bore and another bore opening through its outer edge and communicating with the transverse bore. The lockset includes a latch bolt and a dead bolt which are mounted in side-by-side relation on the door. One of the bolts is received within the bore in the edge of the door and the other of the bolts is rim mounted on an associated face of the door. The dead bolt is operated from the outside by an outside dead bolt operator or lock cylinder, mounted in fixed position relative to the door, and from the inside by an inside dead bolt operator such as a turnpiece or another lock cylinder. Inside and outside latch bolt operators are at all times operable to retract the latch bolt. The inside and outside dead bolt operators and the inside and outside latch bolt operators are respectively connected together through the transverse bore.

DETAILED DESCRIPTION OF PREFERRED EMBODIMENT

Figure 1:
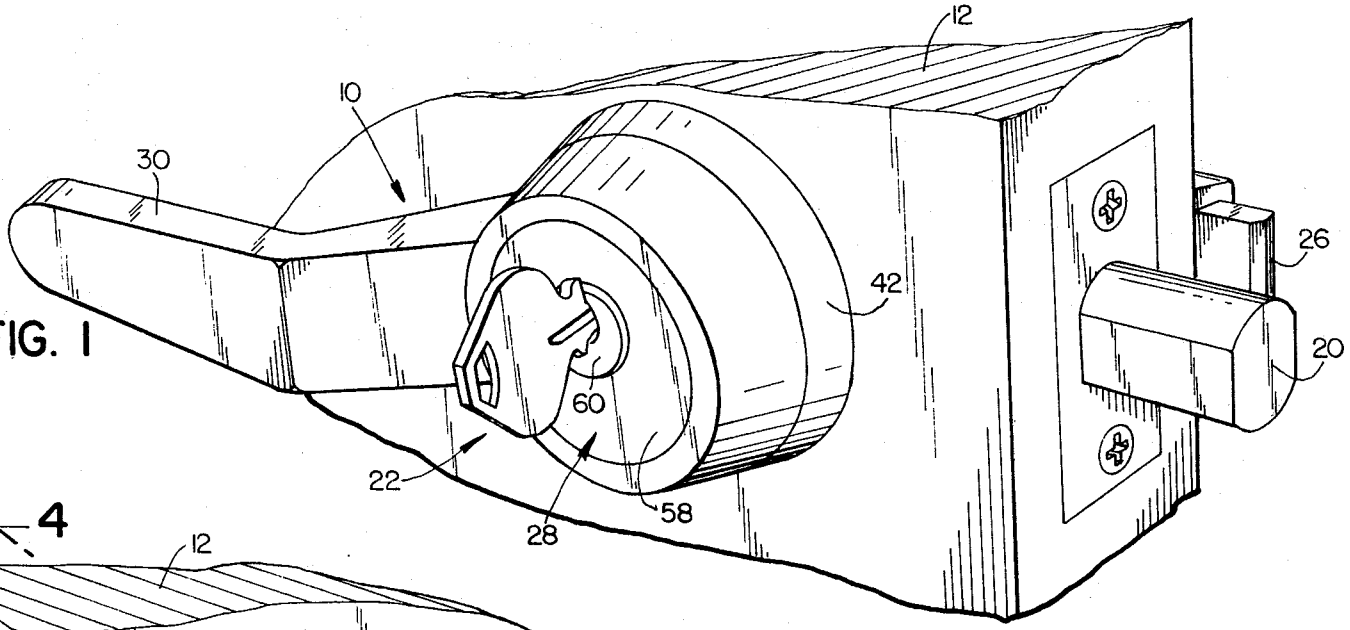
FIG. 1 is a perspective view of a lockset embodying the present invention and shown mounted on a door.
Figure 2:
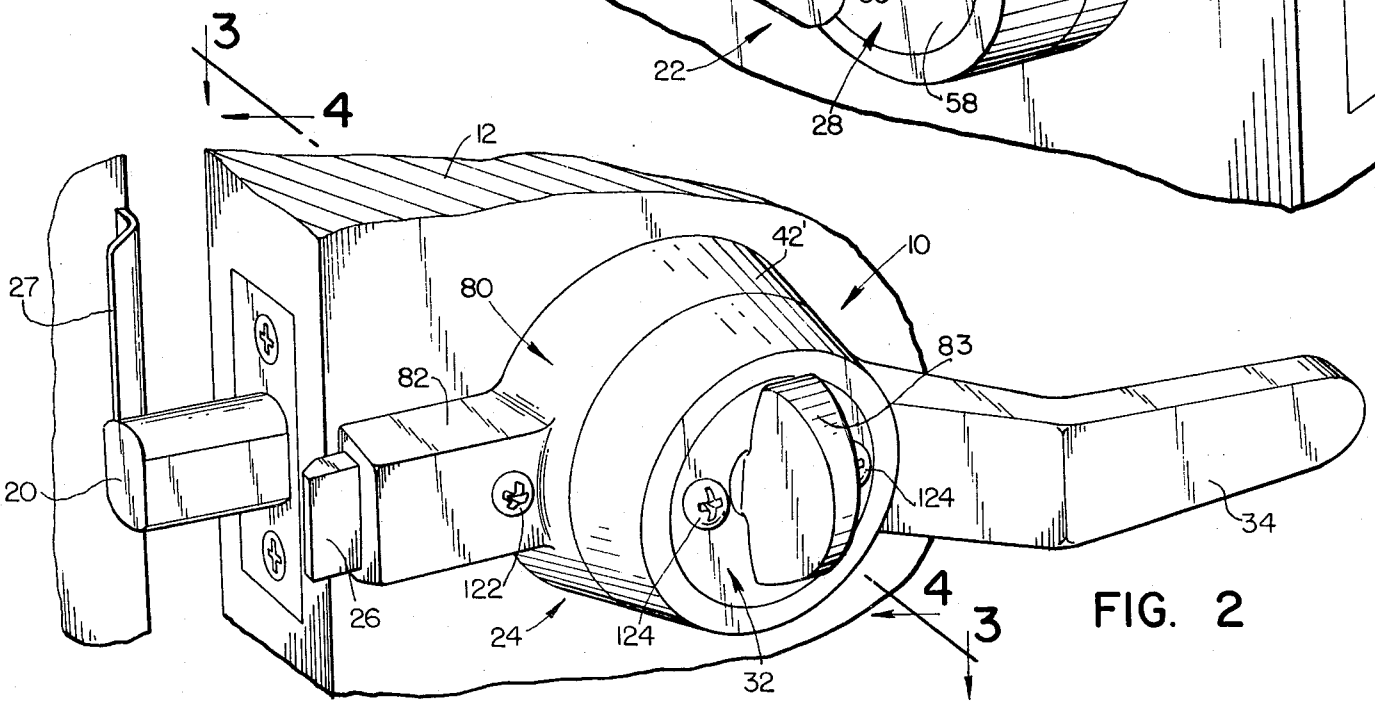
FIG. 2 is a perspective view of the lockset of FIG. 1 as viewed from the opposite side of the door.

Turning now to the drawings and referring first particularly to FIGS. 1-4, a retrofit lock embodying the present invention and indicated generally by the reference numeral 10 is shown mounted on a door 12 which has a transverse bore 14 and another bore 16 which opens through a beveled edge of the door and communicates with the bore 14. The illustrated lockset 10 generally comprises a dead bolt unit indicated generally at 18 which is mounted within the bore 16 and includes a dead bolt 20. The lockset 10 further includes an outside operating assembly indicated generally at 22, mounted on the outer face of the door 12, and an inside operating assembly designated generally by the numeral 24, which is mounted on the inner face of the door 12 and includes a latch bolt 26. The dead bolt 20 and the latch bolt 26 are mounted in side-by-side relation for engagement with a common strike 27 mounted on the door jamb and are further arranged for movement between projected and retracted positions relative to the beveled edge of the door 12. The outside operating assembly 22 includes an outside dead bolt operating unit or a lock cylinder, indicated generally at 28 and mounted in fixed position relative to the door 12, and an outside latch bolt operator or lever handle 30, journalled on the lock cylinder 28 for limited angular movement relative to the lock cylinder and the door. The inside operating assembly 24 includes an inside dead bolt operating unit or turnpiece assembly mounted in fixed position relative to the door and indicated generally at 32. An inside latch bolt operator or inner lever handle 34, which comprises part of the inside operating assembly, is journalled on the turnpiece assembly 32 for limited angular movement relative to the turnpiece assembly and the door 12. The lock cylinder 28 and the turnpiece assembly 32 are connected to the dead bolt unit 18 within the bore 14 and are operable independently of each other to move the dead bolt 20 between projected and retracted positions. The inside and outside lever handles 34 and 30 are also connected together through the bore 14, move in unison, and are at all times operable to move the latch bolt 26 to retracted position out of engagement with the strike 27.

Figure 11:
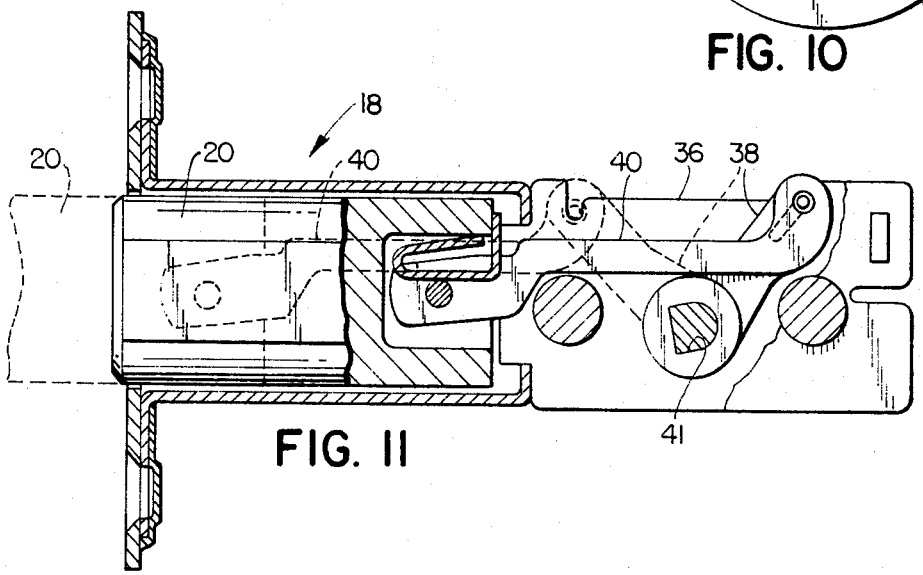
FIG. 11 is a sectional view through the dead bolt unit and taken along the line 11—11 of FIG. 3.

Considering the lockset 10 in further detail, the dead bolt unit 18, best shown in FIG. 11, is of a well known type and has a bolt housing which supports the dead bolt 20 for sliding movement between its projected and retracted positions. A frame 36 extends rearwardly from the bolt housing and provides journal support for a slotted crank 38 which is connected by a link 40 to the dead bolt 20. The crank has a non-cylindrical central aperture 41 therethrough and is arranged for limited angular movement in either direction relative to the frame 38 to impart corresponding rectilinear movement to the dead bolt 20, whereby to move the dead bolt between projected and retracted positions indicated, respectively, by broken and full lines in FIG. 11. The illustrated dead bolt unit 18 is manufactured and marketed by Kwikset Division, Emhart Industries, Inc., Anaheim, Calif., and is further identified as Catalog No. 2728 Dead Bolt. A bolt unit of the aforedescribed general type is further illustrated and described in U.S. Pat. No. 4,012,919, issued Mar. 22, 1977, and assigned to the assignee of the present invention and reference may be had to the aforesaid patent for further description of such a dead bolt unit.

Figure 3:
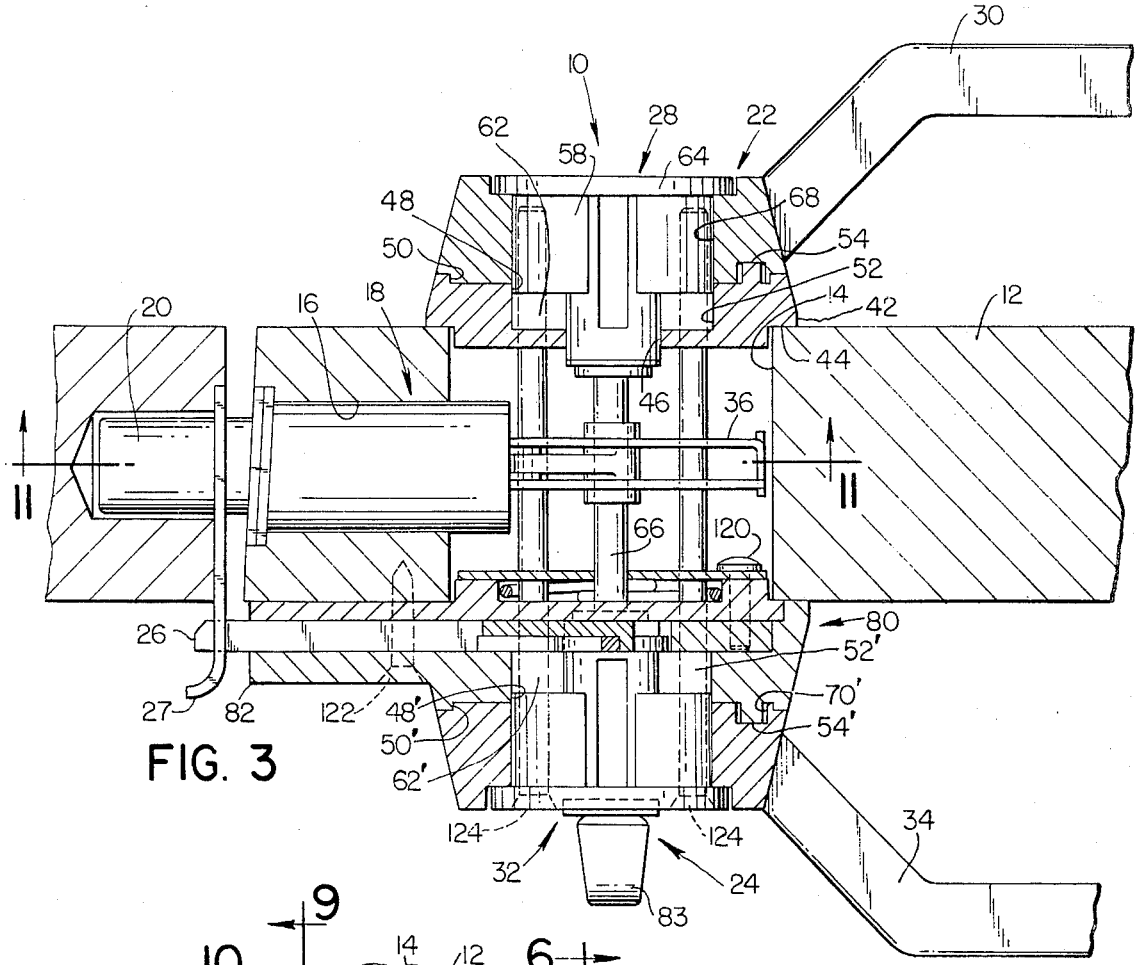
FIG. 3 is a sectional view taken generally along the line 3—3 of FIG. 2.
Figure 4:
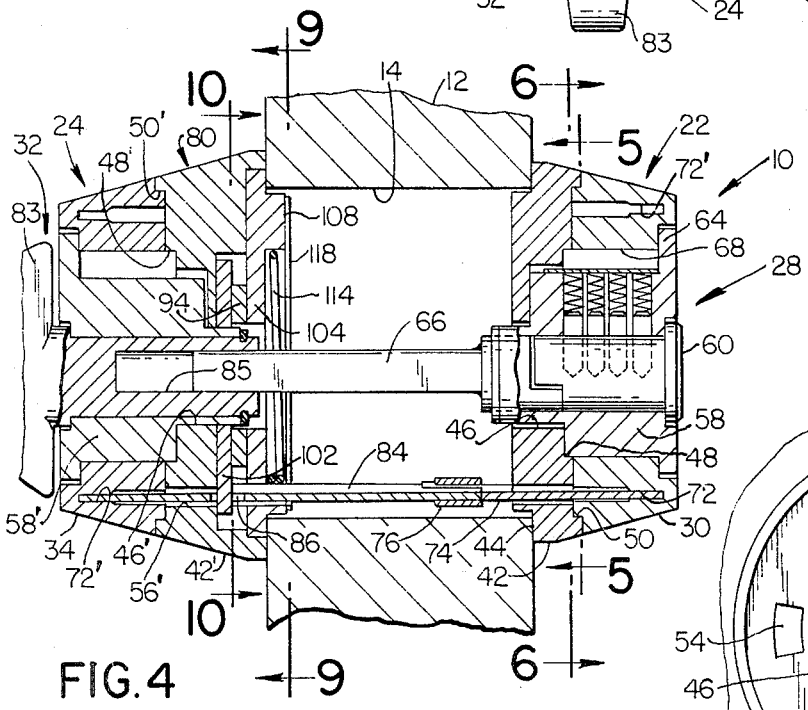
FIG. 4 is a sectional view taken along the line 4—4 of FIG. 2, the dead bolt not shown.
Figure 5:
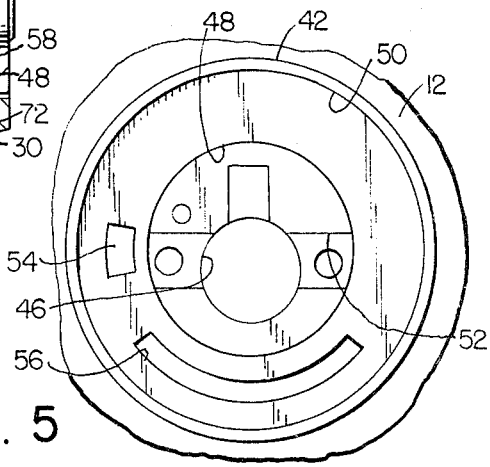
FIG. 5 is an elevational view of the outer rose as viewed generally along the lines 5—5 of FIG. 4.

The outside operating assembly 22 has an outside rose 42 which supports the lock cylinder 28 and the outside lever handle 30. The rose 42 is preferably a die-cast part and has a generally cylindrical inner end portion of reduced diameter which extends into and complements an associated portion of the bore 14 to maintain the outside operating assembly in coaxial alignment with the bore, as shown in FIGS. 3 and 4. An annular bearing surface 44, which faces inwardly or toward the door 12, surrounds the inwardly projecting inner end portion of the rose 42 and bears against an associated portion of the outer face of the door. Spurs (not shown) are or may be provided which project inwardly from the bearing surface 44 to incise the face of the door and retain the outside rose against rotation relative to the door, in a manner well known in the art. A central aperture 46 formed in the outside rose 42 receives the inner end portion of the lock cylinder 28. A shallow cylindrical recess 48 formed in the outer end of the outside rose and opens outwardly, or away from the door, into the somewhat larger concentric, shallow cylindrical recess 50. A generally diametrically extending keyway 52 opens outwardly through the inner wall of the recess 48. The outside rose 42 further includes a stop lug 54 which projects outwardly from the inner wall of the recess 50 at the nine o'clock position, as best shown in FIG. 5. An arcuate slot 56, located near the bottom of the outside rose, extends through the rose and opens outwardly through the inner wall of the recess 50, as best shown in FIG. 5.

The illustrated lock cylinder 28 comprises a conventional pin tumbler lock cylinder which includes a generally cylindrical shell 58. A key plug 60 supported for rotation within the shell 58 is retained in locked position relative to the shell by a plurality of pin tumbler assemblies. Insertion of a proper key into a key slot in the key plug raises and lowers pin tumbler assemblies relative to a shear line between the plug and shell whereby the plug is freed for rotation relative to the shell, in a manner well known in the art. The outside diameter of the shell 58 is substantially equal to the inside diameter of the cylindrical recess 48. An inner end of the shell is received within the latter recess and has a diametrically extending key 62 which projects into and generally complements the keyway 52 to retain the lock cylinder 28 against rotation relative to the outside rose 42. At its outer end the shell 58 has a diametrically enlarged annular flange 64. The key plug carries a hollow tubular tailpiece 66 which is closed at its outer end and connected to the inner end of the key plug through a conventional loss motion connection (not shown).

Figure 6:
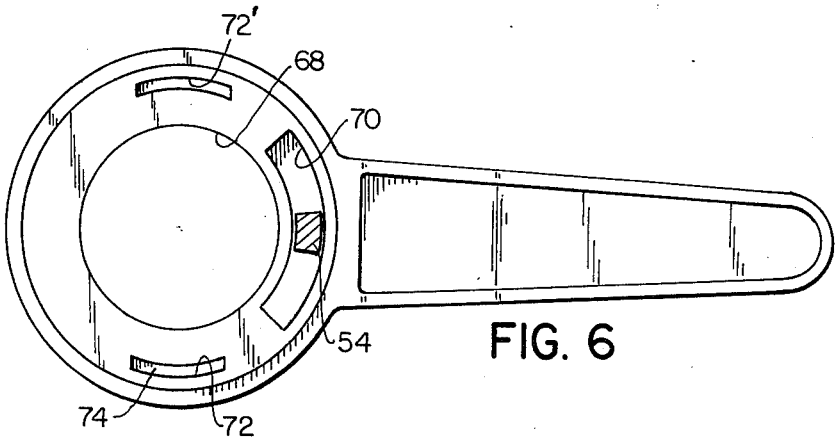
FIG. 6 is an elevational view of the outer lever handle as viewed generally along the line 6—6 of FIG. 4.
Figure 8:
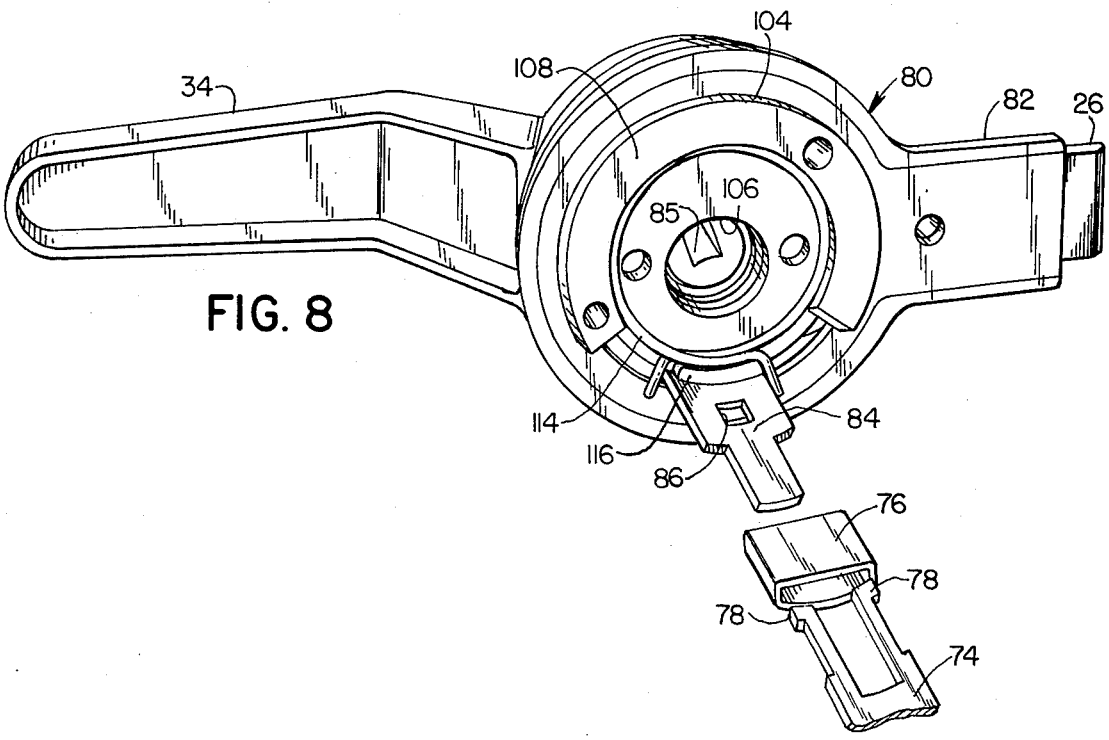
FIG. 8 is a perspective view similar to FIG. 7 but shows the inner operating assembly with the spring cover removed therefrom.

The outside lever handle 30 is preferably a die-case part supported for limited angular movement by the cylinder shell 58 and has a generally cylindrical bore 68 through which the cylindrical shell extends. A diametrically enlarged cylindrical recess in the hub portion of the lever handle 30 opens outwardly through the outer end of the outside lever handle and receives the annular flange 64 which retains the outside lever handle in assembly with the outside rose 42. At its inner end the hub portion of the handle 30 has a diametrically reduced cylindrical portion which is received within and complements the shallow cylindrical recess 50 in the outside rose, as best shown in FIGS. 3 and 4. An inwardly opening arcuate recess 70 formed in the inner side of the hub portion (FIG. 6) receives the stop lug 54 which limits angular movement of the outside lever handle relative to the rose 42. As shown, the stop lug 54 cooperates with the recess 70 to permit approximately 33 degree angular movement of the handle in either direction from its horizontal position, in which it appears in the drawings. The handle 30, as shown in FIG. 6, has inwardly opening arcuate slots 72, 72' at the six and twelve o'clock positions. A latch bolt retractor 74 driven into the lower slot 72 extends for some distance into the bore 14. The unused slot 72' is adapted to receive a latch bolt retractor when the lever handle is set up for opposite hand operation. The inner end of the retractor 74 is bifurcated, as best shown in FIG. 8. A tubular latch retractor sleeve 76 is slidably received upon the bifurcated end portion of the latch bolt retractor 74 and is retained in assembly thereon by transversely projecting lugs 78, 78 on the retractor. The outside lever handle 30 cooperates with the outside rose 42 to define an envelope which contains the lock cylinder 28.

The inside operating assembly 24 has an inside rose housing, indicated generally at 80, which supports the latch bolt 26 and contains a latch bolt retracting mechanism, hereinafter further described. The inside rose housing is similar in some respects to the outside rose 42, previously described, in that it has a generally cylindrical main portion 42' which supports the inside dead bolt operating assembly 32, retains it in fixed position relative to the door 12, and also supports the inside lever handle 34, which is substantially identical to the outside lever handle 30. However, the inside rose housing 80 differs from the outside rose 42 in that it includes an integral radially projecting latch bolt housing portion indicated by the numeral 82. A central aperture 46' formed in the inside rose housing 80 receives the inner end of the turnpiece assembly 32. A concentric shallow recess 48' formed in the inside rose housing opens outwardly into a somewhat larger shallow cylindrical recess 50' formed in the main portion 42'. A keyway 52' is also provided which opens through the inner wall of the recess 48'. A stop lug 54' projects outwardly from the inner wall of the recess 50' at the nine o'clock position, as viewed looking toward the inner side of the door and as best shown in FIG. 3. A slot 56' extends through the inside rose housing and opens through the inner wall of the recess 50'.

The turnpiece assembly 32 has a generally cylindrical outer shell 58' which is identical in many respects to the lock cylinder shell 58, previously described. A turnpiece 83 journalled for rotation within a bore in the shell 58' is retained in assembly with the shell 58' by a snap ring or the like, received on the inner end of the turnpiece. A non-cylindrical blind bore 85 which has a cross-sectional configuration generally complementing the cross-sectional configuration of the tailpiece 66 opens through the inner end of the turnpiece 83 and receives an associated end portion of the tailpiece 66 therein. The outer shell 58' which has a diametrically extending key 62' at its inner end for engagement within the keyway 52'. A diametrically enlarged annular flange 64' at the outer end of the shell 58' is received within a diametrically enlarged cylindrical recess in the outer end of the inside lever handle 34, as best shown in FIG. 3 and retains the inside lever handle 34. The lever handle, in turn, cooperates with the inside rose housing 80 to form an envelope which contains at least the shell portion of the turnpiece assembly 32.

Figure 7:
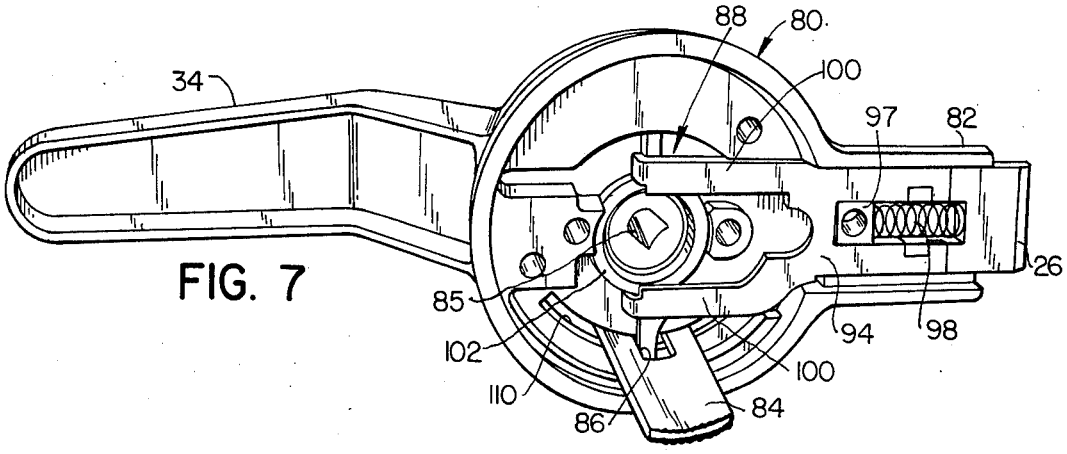
FIG. 7 is a perspective view of the inner operating assembly as viewed from the inner side and with the back plate removed therefrom.

The stop lug 54' is received within an arcuate slot 70 in the inner side of the inside lever handle 34, in the manner previously described, whereby the lever handle 34 is supported for limited angular movement in one and an opposite direction from its horizontal position. An inside latch bolt retractor 84 driven into the lower slot 72' in the inside lever handle 34 extends inwardly through the slot 56' formed in the inside rose housing and has a rollback aperture 86 therethrough, as best shown in FIGS. 7 and 8. The inner end portion of the retractor 84 is reduced in width and is adapted to be received within the sleeve 76 and between the inwardly extending ends of the bifurcated retractor 74 carried by the outside operating assembly, when the inner and outer operating asemblies 24 and 22 are assembled on the door 12. Thus, the inside and outside lever handles are connected together within the bore 14 to move in unison.

Figure 12:
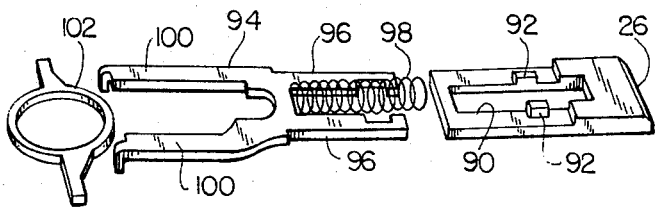
FIG. 12 is an exploded perspective view showing the latch bolt and part of the latch bolt retracting mechanism.

Referring now particularly to FIGS. 3, 4, 7 and 12, the latch bolt 26 and its associated retractor mechanism, indicated generally at 88, and best shown in FIG. 7, are disposed within a shallow recess formed in the inner side of the inside rose housing 80. The latch bolt 26 preferably comprises a die-cast part slidably received within the latch housing portion 82 and has a rearwardly extending slot 90 formed therein and laterally extending lugs 92, 92 thereon. A latch tail 94 has a pair of forwardly extending legs 96, 96 notched to engage the lugs 92, 92 as best shown in FIGS. 7 and 12, whereby it is connected to the latch bolt 26. An integral boss 97 (FIG. 7) formed on the inside rose housing extends inwardly through the slot 90 and serves as a stop to limit projection of the latch bolt 26. The boss 97 also provides an abutment surface for a latch spring 98 which acts between the latch bolt 26 and the boss 97 to bias the latch bolt toward its projected position wherein it extends beyond the beveled edge of the door 12. The latch tail 94 has spaced apart rearwardly extending legs 100, 100. The free end portions of the legs 100, 100 are bent outwardly to engage radially extending arms on an operating member or rollback 102 journalled on the inner end of the turnpiece shell 58'. The lower leg of the rollback 102 is engaged within the aperture 86, as best shown in FIG. 7.

Figure 9:
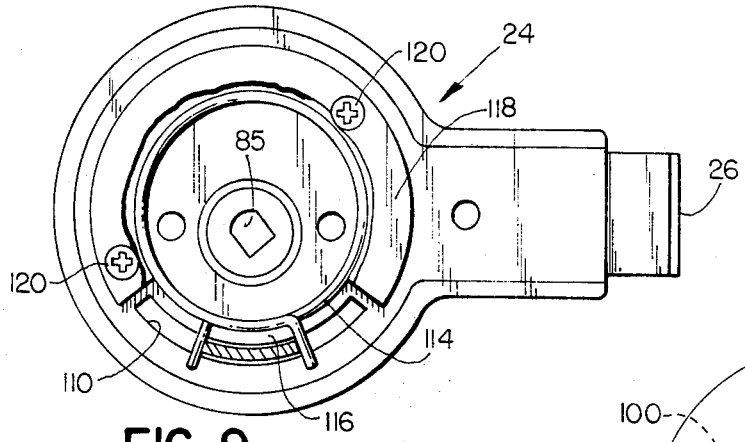
FIG. 9 is an elevational view of the inner operating assembly as viewed generally along the line 9—9 of FIG. 4, a portion of the spring cover shown broken away.
Figure 10:
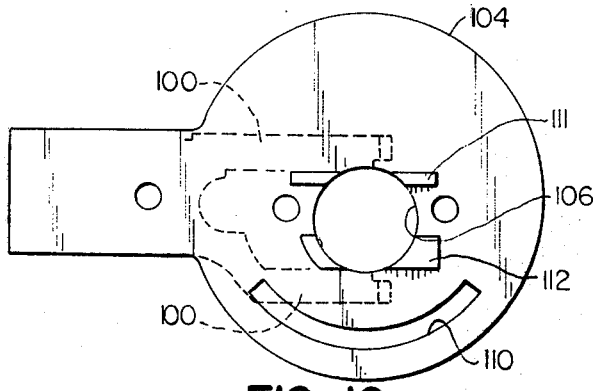
FIG. 10 is an elevational view of the back plate as viewed generally along the line 10—10 of FIG. 4.

A back plate 104 received with a complementary recess in the inner side of the inside rose housing 80 generally overlies the latch tail 94 and at least a portion of the latch bolt 26 in its projected position and retains the latch bolt, the latch tail 94, and the rollback 102 in operative alignment within the inside rose housing 80. The back plate 104 has an aperture 106, through which the tailpiece 66 extends, and an inwardly projecting parti-cylindrical portion 108, the diameter of which is substantially equal to the diameter of the bore 14. The back plate portion 108 extends into the bore 14 and maintains the inside rose housing 80 in coaxial alignment with the bore. The retractor 84 extends through an arcuate slot 110 formed in the lower portion of the back plate. Guide projections 111 and 112 extend outwardly from the outer surface of the back plate 104, as shown in FIG. 10, are disposed between the legs 100, 100, and serve to guide the latch tail 94 for rectilinear movement within the inside rose housing. A lever centering spring 114 normally maintains the inner and outer lever handles 30 and 34 in horizontally disposed position and is mounted within a shallow inwardly opening recess in the back plate. The spring 114 comprises a single loop torsion spring which has radially disposed free end portions adapted to resist angular movement. A spring centering lug 116 which has a width substantially equal to the width of an associated portion of the retractor 84 extends inwardly from the back plate 104 between the free ends of the spring 114 and above the central portion of the arcuate slot 110. The centering lug 116 provides radial abutment surfaces for engaging one of the legs of the spring 114 when the retractor exerts opposing biasing force against the other leg of the spring in response to rotation of either of the lever handles 30 and 34. Thus, the spring 114 acts to center each lever handle in a generally horizontally disposed position. A spring cover 118 overlies the back plate as best shown in FIG. 9. Fasteners 120, 120 extend through the spring cover 118 and the back plate 104 and threadably engage the inside rose housing 80 to retain the spring cover and back plate in assembly with the housing. The outside operating assembly 22, the inside operating assembly 24 and the dead bolt unit 18 are retained in assembly by through bolts 124, 124 which extend through holes in the turnpiece cylinder 58', through holes in the frame 36, and are threaded into blind holes which open through the inner end of the lock cylinder shell 58.

When the lockset 10 is installed on a prepared door such as the door 12, the dead bolt unit 18 with the dead bolt 20 in retracted position is first inserted into the bore 16. Thereafter, the outer operating assembly 24 is inserted into the bore 14 from the outer side of the door while the outer lever handle 34 is held in a generally horizontal position. The tailpiece 66 is aligned with the complementary non-cylindrical central opening 41 in the crank member 38 and inserted therethrough. The inwardly projecting cylindrical portion of the outside rose 42 is then inserted into the bore 14. When the annular abutment surface 44 is brought into general engagement with the outer face of the door 12 the tailpiece 66 will project through the bore 14 and for some distance beyond the inner face of the door. The extending tailpiece 66 may be readily aligned with and inserted into the complementary non-cylindrical bore 85 in the inner end of the turnpiece 83, since the inside lever handle 34 is held in its normally horizontal rearwardly extending position by the lever spring 112. The inwardly projecting parti-cylindrical back plate portion 108 is next inserted into the bore 14 so that the inside operating assembly 22 is generally coaxially aligned with the bore 14 and with the outside operating assembly 24. Through bolts 124, 124, may now be inserted into and through the turnpiece shell 58' and through holes in the latch bolt frame 36 to threadably engage the blind openings in the lock cylinder shell 58. Tightening the through bolts brings such spurs as may be provided on the inner and outer operating assemblies into incising relation with associated faces of the door 12. A wood screw 122 is inserted into the inside rose housing 80 through the boss 97 and is screwed into the door 12 to further secure the inner rose assembly to the door. The front plate of the dead bolt unit 18 is secured to the edge of the door by screws, in a conventional manner.

Since the dead bolt 20 has a one inch throw it may be necessary to enlarge the dead bolt receiving opening in the door jamp before the strike plate 27 is installed. Thereafter, if desired, a box strike may be inserted into the opening in the door jamb and the strike plate secured to the door jamb, in conventional manner, to complete the lockset installation.

The latch bolt 26 is normally biased to projected position by the latch spring 98 but may be retracted by rotating either lever handle in either direction. The latch bolt retractors 74 and 84, which are telescopically connected with the bore 14, move in unison against the opposing biasing force of the lever centering spring 114 in response to movement of either of the lever handles 30 or 34. The lower leg of the rollback 102, which is engaged within the aperture 86, causes the rollback to move angularly with the retractors 74 and 84 whereby the latch tail 94 and the latch bolt 26 connected thereto are retracted in a convential manner against the opposing biasing force of the latch spring 98. The dead bolt 20 is moved between projected and retracted positions from the outside of the door by inserting a proper key into the lock cylinder 28 and turning the key through one full revolution to its shed position wherein it may be withdrawn from the lock cylinder leaving the dead bolt locked in desired position. The dead bolt may also be operated from the inside by turning the turnpiece 83 through an angle of 90 degrees.

The illustrated lock 10 is provided with inside and outside lever handles for operating the latch bolt, however, it should be understood that other kinds of operators such as knobs, for example, may be used in place of lever handles and such arrangements are contemplated within the scope of the invention. Further, the lock has been illustrated and described with reference to a turnpiece assembly, however, it will be readily apparent to those skilled in the art that only slight modification will be required to adapt the lockset 10 to accommodate a lock cylinder for use as an inside dead bolt operator.

We claim:

1. A lockset for a door having a transverse bore therethrough and another bore opening through one edge of the door and communicating with the transverse bore, said lockset comprising a dead bolt and a latch bolt, means for mounting one of the bolts comprising said dead bolt and said latch bolt in said other bore for movement between projected and retracted positions relative to the one edge, means for mounting the other of said bolts in side-by-side relation to said one bolt and generally adjacent to one face of the door for movement between projected and retracted positions relative to the one edge, a first latch bolt operator, means for supporting said first latch bolt operator on one face of the door and in alignment with the transverse bore to move relative to the door, a second latch bolt operator, means for mounting said second latch bolt operator on another face of the door opposite the one face and in alignment with the transverse bore to move relative to the door, means for moving said latch bolt to a retracted position in response to movement of either of the latch bolt operators, a first dead bolt operating unit, means for supporting said first dead bolt operating unit on and in fixed relation to the door, said means for supporting said first dead bolt operating unit cooperating with said first latch bolt operator to define an envelope containing said first dead bolt operating unit, and means operably connected to said dead bolt for moving said dead bolt between projected and retracted positions in response to operation of said first dead bolt operating unit.

2. A lockset as set forth in claim 1 wherein said first dead bolt operating unit comprises said means for supporting said first latch bolt operator.

3. A lockset as set forth in either claim 1 or 2 wherein said first latch bolt operator is supported for coaxial angular movement relative to said first dead bolt operating unit.

4. A lockset as set forth in claim 3 wherein said first latch bolt operator has a bore and said first dead bolt operating unit has a shell received in said bore and supporting said first latch bolt operator for angular movement thereon.

5. A lockset as set forth in claim 4 wherein said means for supporting said first dead bolt unit comprises a rose having an inwardly facing bearing surface for engaging an associated portion of the one face and an outwardly opening recess receiving an associated inner end portion of said shell, said bore in said first latch bolt operator and said outwardly opening recess cooperating to define said envelope.

6. A lockset as set forth in claim 5 wherein said shell has a diametrically enlarged annular flange at its outer end and said bore has a diametrically enlarged annular recess at its outer end receiving said flange therein, said rose and said flange cooperating to retain said first latch bolt operator in assembly with said shell.

7. A lockset as set forth in claim 6 wherein said rose has a keyway formed therein and communicating with said outwardly opening recess and said shell has a key thereon received in said keyway and retaining said shell against rotational movement relative to said rose.

8. A lockset as set forth in claim 6 wherein said first latch bolt operator comprises a lever handle.

9. A lockset as set forth in claim 3 wherein said first dead bolt operating unit comprises a lock cylinder.

10. A lockset as set forth in claim 3 wherein said first dead bolt operating unit comprises a turnpiece assembly.

11. A lockset mounted on a door having a transverse bore and another bore opening through an edge of said door and communicating with said transverse bore, said lockset having a bolt unit including a bolt housing supported in said other bore and a first bolt supported in said bolt housing for movement between projected and retracted positions relative to said one edge, said lockset having inside and outside operating assemblies respectively mounted on the inside and outside faces of said door, said lockset having a second bolt supported by one of said operating assemblies for movement between projected and retracted positions relative to the one edge, one of the bolts comprising said first and second bolt being a latch bolt and the other of said bolts being a dead bolt, said outside operating assembly including a rose having a bearing surface for engaging said outside face and means for maintaining said rose in alignment with said transverse bore, said outside operating assembly including an outside dead bolt operating unit having a cylindrical shell supported on said rose and projecting axially therefrom in a direction away from said door, a cylindrical dead bolt operator journaled in said shell, and means restraining said shell against rotation relative to said rose, said outside operating assembly including an outside latch bolt operator journaled on the projection portion of said shell and having a cylindrical bore receiving said projecting portion, said projecting portion being wholly contained within said outside operator.

12. The combination as set forth in claim 11 wherein said restraining means comprises a key on the inner end of said shell and a complementary key slot in said rose receiving said key therein.

13. The combination as set forth in claim 11 wherein said outside operating unit comprises a lock cylinder.

14. The combination as set forth in claim 11 wherein said inside operating assembly includes an inside rose housing and said second bolt is supported within said inside rose housing generally adjacent said inside face and in side-by-side relation with said first bolt.

15. The combination as set forth in claim 14 wherein said inside operating assembly includes a latch bolt retracting mechanism operably connected to said latch bolt and an inside latch bolt operator supported on said rose and operably connected to said latch bolt retracting mechanism.

16. The combination as set forth in claim 15 wherein said first bolt comprises said dead bolt and said second bolt comprises said latch bolt.

17. The combination as set forth in claim 15 wherein said inside operating assembly includes an inside dead bolt operating unit supported on said inside rose housing and said inside latch bolt operator is journaled on said inside dead bolt operating unit.

18. A lockset for a door having a transverse bore therethrough and another bore opening through one edge of the door and communicating with the transverse bore, said lockset comprising a dead bolt and a latch bolt, one of the bolts comprising said dead bolt and said latch bolt being adapted for mounting in said other bore for movement between projected and retracted positions relative to the one edge, the other of said bolts being adapted for mounting in side-by-side relation to said one bolt and generally adjacent a face of the door for movement between projected and retracted positions relative to the one edge, a first latch bolt operator, a first housing for supporting said first latch bolt operator on one face of the door and in alignment with the transverse bore to move relative to the door and the first housing, a second latch bolt operator, a second housing for mounting said second latch bolt operator on another face of the door opposite the one face and in alignment with the transverse bore to move relative to the door and the second housing, said latch bolt being movable to a retracted position in response to movement of either of the latch bolt operators, and a first dead bolt operating unit operably connected to said dead bolt for moving said dead bolt between projected and retracted positions in response to operation of said first dead bolt operating unit, the improvement comprising said first dead bolt operating unit being mounted in fixed position on said first housing, said first latch bolt operator being journalled on said first dead bolt operating unit for angular movement relative thereto, and said first housing cooperating with said first latch bolt operator to define an envelope containing said first dead bolt operating unit.

* * * * *